United States Patent [19]

Block et al.

[11] 4,439,953

[45] Apr. 3, 1984

[54] ABRASIVE DISC HOLDER

[75] Inventors: Aleck Block, Los Angeles; Hiroshi Hasegawa, Whittier, both of Calif.

[73] Assignee: Merit Abrasive Products, Inc., Compton, Calif.

[21] Appl. No.: 321,583

[22] Filed: Nov. 16, 1981

[51] Int. Cl.[3] ..... B24D 9/08

[52] U.S. Cl. ..... 51/389; 51/378

[58] Field of Search ..... 51/358, 376, 377, 378, 51/388, 389, 379

[56] References Cited

U.S. PATENT DOCUMENTS

| | | | |
|---|---|---|---|
| 3,491,494 | 1/1970 | MacKay | 51/358 |
| 3,562,968 | 2/1971 | Johnson et al. | 51/358 X |
| 3,574,978 | 4/1971 | Block | 51/377 |
| 3,667,170 | 6/1972 | MacKay | 51/389 |
| 3,747,286 | 7/1973 | Haigh | 51/379 X |

*Primary Examiner*—Frederick R. Schmidt
*Assistant Examiner*—Robert P. Olszewski
*Attorney, Agent, or Firm*—Charles H. Schwartz; Ellsworth R. Roston

[57] ABSTRACT

A holder for supporting an abrasive disc having a centrally located nut member and with the nut member including a flange portion located adjacent the disc and a thread portion extending from the flange portion, the holder including a central metallic member, a stud member extending through the central metallic member and including a threaded end portion, a flexible pad portion supported by and extending radially outwardly from the central metallic member to support the abrasive disc, a stop member composed of a low friction plastic material and with a first portion of the stop member disposed around and spaced from the threaded end portion of the stud member and with a second portion of the stop member located adjacent to the central metallic member and with the stop member captured in position for free rotation relative to the central metallic member and the stud member when the holder is not-supporting the abrasive disc, and the threaded end portion of the stud member for receiving the threaded portion of the nut member of the abrasive disc to thread the abrasive disc onto the holder and with the second portion of the stop member for abutting the flange portion of the nut member to compress the stop member to abut the central metallic member as the abrasive disc is threaded onto the holder.

10 Claims, 5 Drawing Figures

ABRASIVE DISC HOLDER

BACKGROUND OF THE INVENTION

1 Field of the Invention

The present invention relates to a holder for an abrasive disc and specifically a holder for a relatively large size abrasive discs.

2 Description of the Prior Art

Prior art abrasive disc holders have included a center portion having an attachment means that interlocks with a complementary attachment means on the abrasive disc. A rubber backing member generally extends outward from a center portion to provide for a flexible support of the abrasive disc during operation. One type of prior art holder for an abrasive disc included a metallic center portion and with a stud member projecting through the metallic portion and with the stud member including a threaded end. The large size disc includes an attached nut member such as a sheet metal nut member having a flange on the abrasive surface of the disc and with the nut projecting backward through a hole in the disc. The nut member may be attached by fingers which extend backward through the disc and bent over. The nut member cooperates with the threaded end of the stud so that the disc may be locked onto the holder by threading the nut member on to the end of the stud and with the disc compressed between the flange portion of the nut member and the metallic portion of the holder as the disc is tightened on the holder.

In prior art, the metallic center support portion and stud are fixed in position and during use of the abrasive disc, the torque causes the nut member to lock onto the stud with greater and greater holding force. Therefore, with the prior art devices the abrasive disc member can become locked very tightly onto the holder so that it becomes difficult to remove the abrasive disc when it is necessary to change the abrasive disc. In addition, since abrasive discs have a certain compressability, the region around the center hole of the disc that lies between the flange of the nut and the metal center of the holder is highly compressed as the nut is tightened by operating torque and acts in the manner of a spring-type lock washer to further lock the nut on the stud.

SUMMARY OF THE INVENTION

With the disc holder of the present invention, abrasive discs and specifically larger sizes of abrasive discs may be easily removed even when the discs are used so as to subject them to high torque which would normally tend to lock the disc onto the holder such as with the prior art holders. In particular, the disc holder of the present invention includes a freely rotatable plastic stop member which is located adjacent to the central metallic portion and is captured in position around the threaded end of the stud member. The plastic member may be made from a low friction hard plastic material so that the member will not tend to bind against the metal parts.

As the nut member attached to the abrasive disc is threaded onto the end of the stud, a metal flange portion of the nut member which is positioned on the underside of the disc lies against an outer edge of the plastic stop member. Further tightening of the abrasive disk on the stud will tend to compress the plastic member so that ultimately the plastic material will serve as a stop to hold the disc in the proper position. As the disc and disc holder are used, torque may tend to tighten the disc even more onto the stud, but the disc itself will not compress since the flange which contacts the plastic stop member is on the underside of the disc. The plastic stop member will tend to resist the tightening so as to prevent the disc from binding onto the holder. More importantly, when the disc is to be removed, a reverse twist of the disc allows for a relative movement of the disc relative to the holder because of the low friction material of the plastic member and thereby provides for the easy removal of the disc from the holder.

The plastic stop member may be formed as a tapered cylinder and with an inner flange portion held in position by a small locking nut which screws onto the threaded end of the stud and captures the plastic member in position around the stud. The nut member attached to the abrasive disc would then screw onto the threaded end of the stud which extends past the locking nut.

A BRIEF DESCRIPTION OF THE DRAWINGS

A clearer understanding of the invention will be had with reference to the following description and drawings wherein FIG. 1 is an exploded perspective view of a disc holder of the present invention and also showing an abrasive disc;

DESCRIPTION OF THE PREFERRED EMBODIMENT

Figure 1:
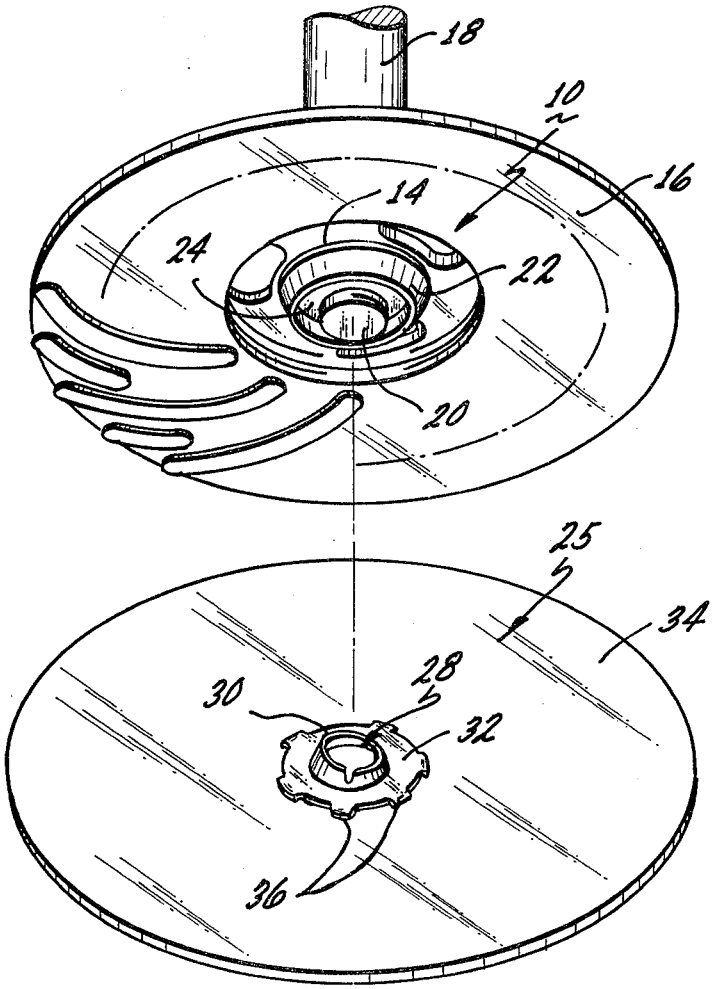
Figure 2:
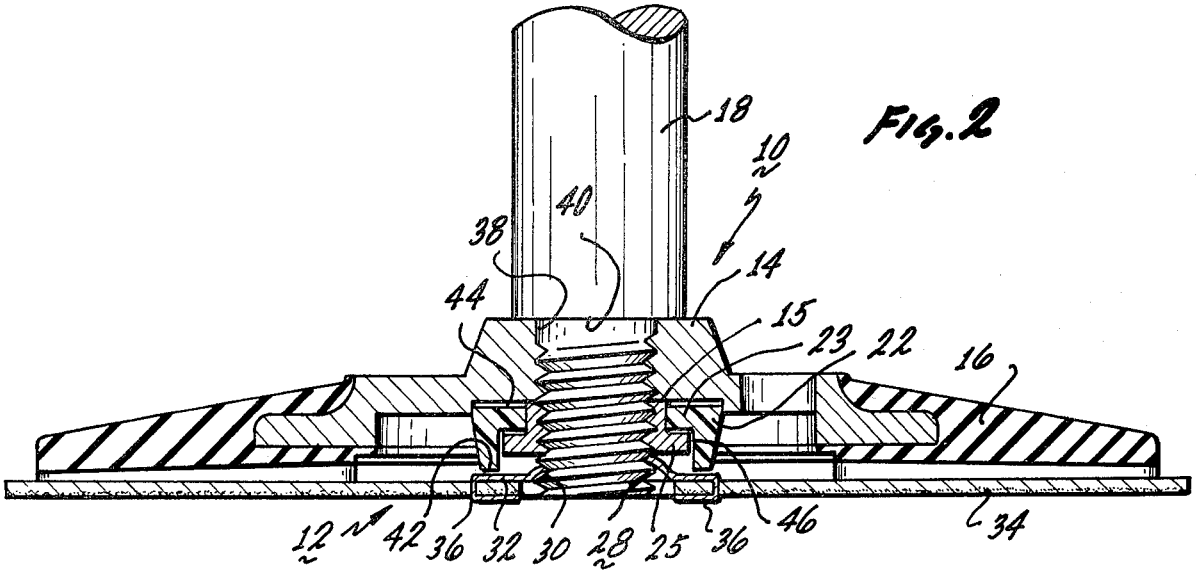
FIG. 2 is a cross-sectional view of the disc holder of the present invention and with the abrasive disc attached in position on the disc holder.
Figure 3:
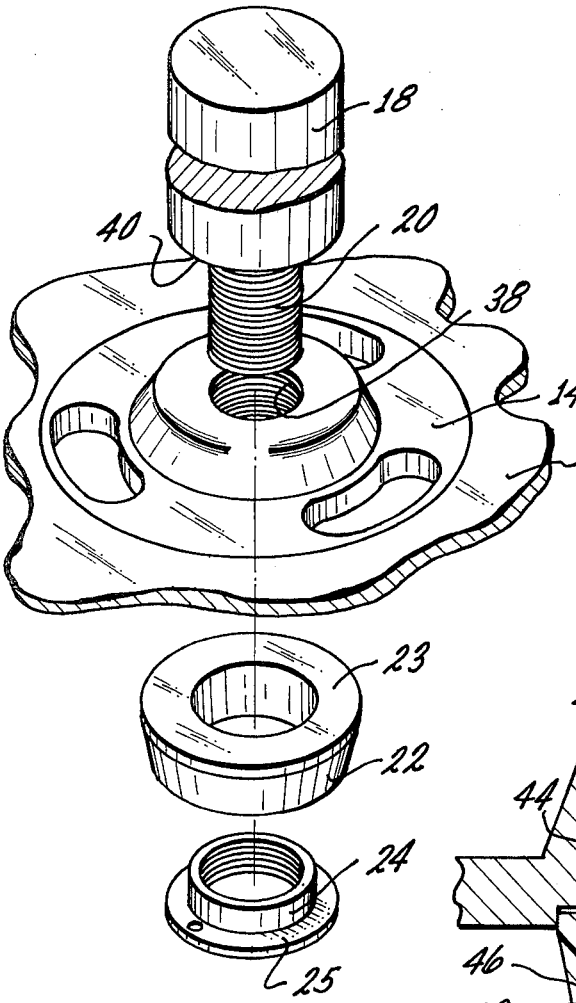
FIG. 3 is an exploded perspective view of the center area of the disc holder of the present invention.

As shown in FIG. 1, the present invention is directed to an abrasive disc holder 10 for use with an abrasive disc 12. The abrasive disc holder 10 includes a central metal portion 14 which supports an extending rubber pad 16 as shown in FIG. 2. A stud member 18 passes through the metal central portion 14 and the stud member 18 includes a threaded end 20. An intermediate plastic member 22 made of low friction material is positioned to surround the threaded end 20 of the stud member. A locking nut 24 threads onto the threaded end 20 of the stud member to capture the plastic member 22 in position and to lock the stud member in position.

The abrasive disc 12 includes a central nut member 28 which, as shown in the drawings, is a sheet metal nut including a single turn 30 supported above a flange 32. The nut member 28 is attached to the underside of a sheet of abrasive material 34 using fingers 36 which pass through the sheet of abrasive material 34 and are bent down onto the front face of the sheet of abrasive material. This is shown in more detail in FIGS. 2, 4 and 5. FIGS. 2 through 5 illustrate in more detail the relationship of the various parts forming the abrasive disc holder of the present invention. For example, as shown in FIG. 2, the central metallic portion 14 includes a threaded portion 38 to receive the threaded end 20 of the stud member 18. When the end 20 of the stud member 18 is fully threaded into the threaded portion 38 of the metallic portion 14, an end surface 40 of the stud prevents the stud 18 from rotating relative to the central metal portion 14. The locking nut 24 is then threaded onto the threaded end portion 20 to thereby lock the plastic member 22 within a recess 15 in the central metal portion 14.

Also as shown in FIGS. 2 through 5, the plastic member 22 includes an inner flanged portion 23 as well as a cylindrical portion and the nut 24 has an outwardly extending flange 25 so that when the locking nut 24 is threaded onto the threaded end 20 of the stud 18, this also captures the flanged portion 23 of the plastic member 22 within the complementary recess 15 in the central metal portion 14 and allows the main cylindrical portion of the plastic member 22 to extend toward the abrasive disc 12.

Figure 4:
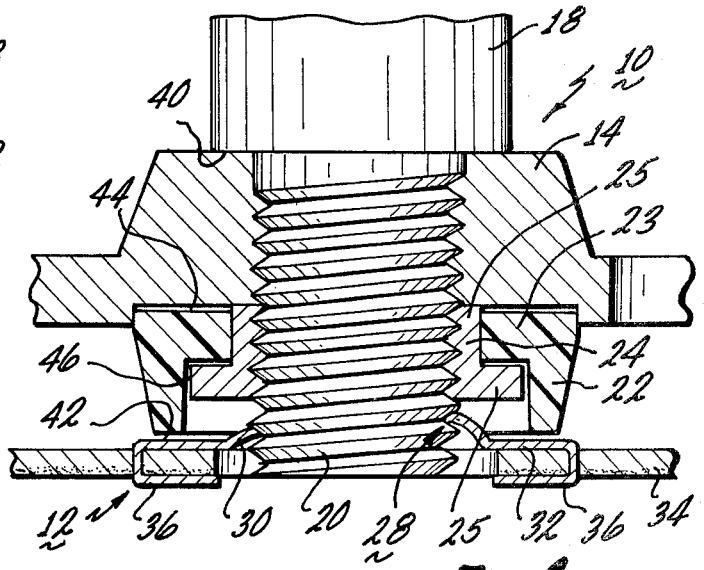
FIG. 4 is an enlarged cross-sectional view of the disc holder of the present invention and with the abrasive disc in an initial attached position.

Also as shown in FIGS. 2 and 4, there is sufficient clearance between the recess 15 and the flange 25 so that prior to the nut member 28 of the abrasive disc 12 being fully tightened onto the threaded end 20 of the stud 18, the plastic member 22 may freely rotate within its captured position. In particular, this is accomplished by having the spacing between the inner surface of the flange 25 and the inner surface of the recess 15 of the central metal portion 14 greater than the height of flanged portion 23 of the plastic member 22. This can be seen by the clearances at positions 42 and 44. In addition, the dimensions of the parts are such that there is a clearance at position 46 to also allow a free rotation of the plastic member. The plastic member may also be advantageously made of a hard low friction material, such as a material sold under the trademark "DELRIN" so as to provide for a proper operation of the disc holder of the present invention.

Figure 5:
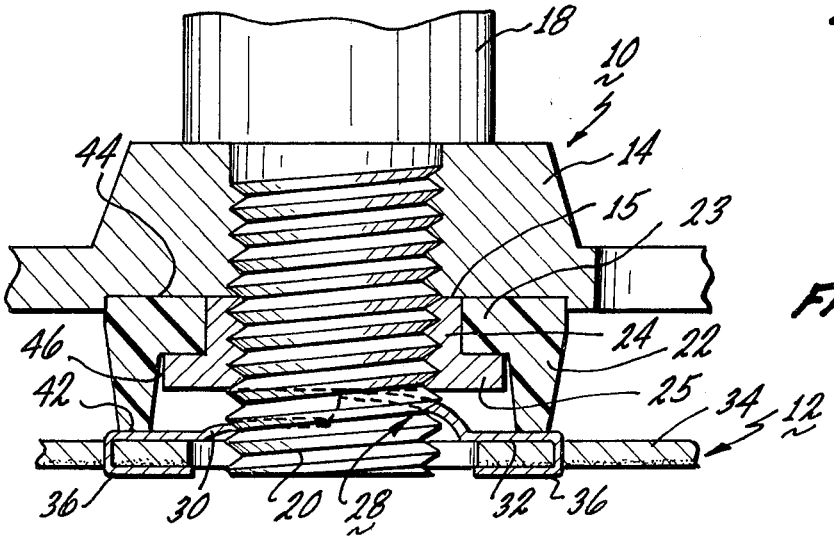
FIG. 5 is an enlarged cross-sectional view similar to FIG. 4 but with the abrasive disc fully tightened onto the disc holder so as to compress the plastic member.

In particular, the operation of the present invention may be seen with reference to FIGS. 4 and 5 which show initially the disc holder with the disc threaded onto the stud member but not fully tightened as shown in FIG. 4 and with the disc fully tightened as shown in FIG. 5. When the disc is not fully tightened as shown in FIG. 4, the flange portion 32 of the sheet metal nut 28 approaches the outer end surface of the plastic member 22. As the disc is further tightened onto the threaded portion of the stud 18, then the flange portion 32 bears against the outer end surface of the plastic member 22, thereby compressing the plastic member. This compression takes up the tolerances in the parts to substantially eliminate the clearances 42, 44 and 46 as shown in FIG. 5. At this position, the disc is disposed tightly on the holder during the operation of the disc so that the disc does not wobble.

When it is desired to remove the disc from the holder, the low friction material from which the plastic member 22 is formed provides for low friction surfaces for the positions of contact. These low friction surfaces allow for relative movement of the disc relative to the holder. This relative movement may occur first at the contact surface between the flange portion 32 and the end surface of the plastic member 22 or may occur first at the contact surface between the portions 15 and 23. In either case, the initial movement breaks the locking arrangement between the disc and the disc holder and then allows a free rotation of the disc 12 relative to the holder 10 which free rotation is aided by the free rotation of the plastic member 22, to thereby uncouple the disc 12 from the holder 10.

The present invention, therefore, provides for an improved disc holder which allows for an easier uncoupling of large abrasive discs through the use of an intermediary low-friction plastic member which provides for a stop so that the abrasive disc is properly locked into position during operation but the plastic member also provides for low-friction surfaces so that the disc may be uncoupled from the disc holder when desired. As an example, the disc holder of the present invention may be used with large abrasive discs such as 5, 7 or 9 inch discs or even larger discs and allows for the removal of these discs even when the discs have been operated in conditions providing high centrifugal forces.

Although the invention has been described with reference to a particular embodiment, it will be appreciated that various adaptations and modifications may be made and the invention is only to be limited by the appended claims.

We claim:

1. A holder for supporting an abrasive disc having a centrally located nut member and with the nut member including a flange portion located adjacent the disc and a thread portion extending from the flange portion, the holder including a central metallic member, a stud member extending through the central metallic member and including a threaded end portion, a flexible pad portion supported by and extending radially outwardly from the central metallic member to support the abrasive disc, a stop member composed of a low friction plastic material and with a first portion of the stop member disposed around and spaced from the threaded end portion of the stud member and spaced from the central metallic member and with a second portion of the stop member located adjacent to and spaced from the central metallic member and with the stop member captured in position for free rotation relative to the central metallic member and the stud member when the holder is non-supporting the abrasive disc, and the threaded end portion of the stud member for receiving the thread portion of the nut member of the abrasive disc to thread the abrasive disc onto the holder and with the first portion of the stop member for abuting the flange portion of the nut member to compress the stop member to abut the central metallic member as the abrasive disc is threaded onto the holder.

2. The holder of claim 1 wherein at least the first portion of the stop member is cylindrical in shape and with the second portion of the stop member including at least a flange portion extending inwardly toward the stud member and with the stop member captured in position by a locking nut threaded on to the threaded end of the stud member and positioned within the cylindrical first portion of the stop member and extending over the flange portion of the second portion of the stop member.

3. The holder of claim 1 wherein the stop member is a flanged cylinder having an outer cylindrical portion and with the second portion forming an inner flanged portion and the first portion forming the outer cylindrical portion and with the central metallic member including a recessed portion complementary to and for receiving the inner flanged portion of the stop member and with the stop member captured in position by a locking nut threaded onto the threaded end of the stud member and with the locking nut including a cylindrical portion positioned within the inner flanged portion to contact the central metallic member and a flange portion extending outwardly to capture the inner flanged portion of the stop member.

4. The holder of claim 1 wherein the stop member is composed of the low friction material designated by the name Delrin.

5. The holder of claim 1 wherein the stud member is formed with an enlarged end portion opposite the threaded end portion and with the central metallic member including a threaded opening to receive the threaded end portion for preventing rotation of the stud member relative to the central metallic member when the threaded end of the stud member is fully threaded into the threaded opening of the metallic member to have the enlarged end portion abut the metallic portion.

6. An abrasive disc and disc holder including an abrasive disc having a centrally located nut member and with the nut member including a flange portion and a threaded portion extending from the flange portion, a disc holder including a central metallic member, and a stud member extending through the central metallic member and including a threaded end portion and a stop member composed of a low friction plastic material and with a first portion of the stop member disposed around and spaced from the threaded end portion of the stud member and spaced from the central metallic member and with a second portion of the stop member located adjacent to and spaced from the central metallic member and with the stop member captured in position for free rotation relative to the central metallic member and the stud member when the holder is not supporting the abrasive disc, and the threaded end portion of the stud member receiving the threaded portion of the nut member of the abrasive disc to thread the abrasive disc onto the holder and with the first portion of the stop member abuting the flange portion of the nut member to compress the stop member to abut the central metallic member as the abrasive disc is threaded onto the holder.

7. The abrasive disc and disc holder of claim 6 wherein at least the first portion of the stop member is cylindrical in shape and with the second portion of the stop member including at least a flange portion extending inwardly toward the stud member and with the stop member captured in position by a locking nut threaded onto the threaded end of the stud member and positioned within the cylindrical first portion of the stop member and extending over the flange portion of the second portion of the stop member.

8. The abrasive disc and disc holder of claim 6 wherein the stop member is a flanged cylinder having an outer cylindrical portion and with the second portion forming an inner flanged portion and the first portion forming the outer cylindrical portion and with the central metallic member including a recessed portion complementary to and receiving the inner flanged portion of the stop member and with the stop member captured in position by a locking nut threaded onto the threaded end of the stud member and with the locking nut including a cylindrical portion positioned within the inner flanged portion to contact the central metallic member and a flange portion extending outward to capture the inner flanged portion of the stop member.

9. The abrasive disc and disc holder of claim 6 wherein the stop member is composed of the low friction material designated by the name Delrin.

10. The abrasive disc and disc holder of claim 6 wherein the stud member is formed with an enlarged end portion opposite the threaded end portion and with the central metallic member including a threaded opening to receive the threaded end portion for preventing rotation of the stud member relative to the central metallic member when the threaded end of the stud member is fully threaded into the threaded opening of the metallic member to have the enlarged end portion abut the metallic member.

* * * * *